US005947569A

United States Patent [19]

Rheault et al.

[11] Patent Number: 5,947,569

[45] Date of Patent: Sep. 7, 1999

[54] FREESTANDING FURNITURE DEFINING OFFICE WITH ADJUSTABLE FOOTPRINT

[75] Inventors: Alan E. Rheault, Grand Rapids; Mark W. Chamberlin, Delton; Samuel J. Ellison, Wyoming; George J. Simons, Grand Rapids, all of Mich.

[73] Assignee: Steelcase Inc., Grand Rapids, Mich.

[21] Appl. No.: 08/857,703

[22] Filed: May 16, 1997

[51] Int. Cl.[6] ..... A47B 17/00

[52] U.S. Cl. ..... 312/194; 312/111; 312/205; 312/317.3; 312/223.6; 108/50.02; 108/64; 108/92

[58] Field of Search ..... 312/107, 108, 312/111, 194, 195, 196, 203, 205, 277, 280, 281, 317.1, 317.3, 223.3, 223.6; 52/36.1; 108/50.02, 64, 69, 90, 92, 93, 101, 185

[56] References Cited

U.S. PATENT DOCUMENTS

| | | | |
|---|---|---|---|
| 1,349,710 | 8/1920 | Beeson . | |
| 1,942,856 | 1/1934 | Davis | 312/277 X |
| 2,614,017 | 10/1952 | Mugnier . | |
| 2,657,811 | 11/1953 | Isler . | |
| 2,661,990 | 12/1953 | Knuth . | |
| 2,744,714 | 5/1956 | Parke . | |
| 2,821,450 | 1/1958 | Knoll | 312/111 |
| 2,988,413 | 6/1961 | Bergen . | |
| 3,008,585 | 11/1961 | McNeill . | |
| 3,049,390 | 8/1962 | Wolfe . | |
| 3,125,387 | 3/1964 | Abrahamson | 312/108 X |
| 3,338,647 | 8/1967 | Schreyer | 312/194 |
| 3,359,930 | 12/1967 | Schreyer | 312/281 X |
| 3,533,362 | 10/1970 | Thompson | 108/64 |
| 3,648,626 | 3/1972 | Schuster . | |
| 3,765,344 | 10/1973 | Ferdinand et al. . | |
| 3,979,156 | 9/1976 | Gross | 312/196 |
| 4,102,275 | 7/1978 | Spound et al. . | |
| 4,279,453 | 7/1981 | Haas . | |
| 4,323,291 | 4/1982 | Ball | 312/196 X |
| 4,365,854 | 12/1982 | Waller . | |
| 4,449,762 | 5/1984 | Turner | 108/92 X |
| 4,559,877 | 12/1985 | Waibel . | |
| 4,600,248 | 7/1986 | Pfieger . | |
| 4,639,049 | 1/1987 | Frascaroli et al. . | |
| 4,713,949 | 12/1987 | Wilcox . | |
| 4,731,960 | 3/1988 | Sease . | |
| 4,821,477 | 4/1989 | Rydqvist . | |
| 4,974,915 | 12/1990 | Bussard . | |
| 5,005,925 | 4/1991 | Diehl . | |
| 5,020,449 | 6/1991 | Forte | 108/92 |
| 5,241,796 | 9/1993 | Hellwig et al. . | |
| 5,255,966 | 10/1993 | Newhouse et al. . | |
| 5,309,686 | 5/1994 | Underwood et al. . | |
| 5,394,658 | 3/1995 | Schreiner et al. . | |
| 5,454,636 | 10/1995 | Taub . | |
| 5,513,575 | 5/1996 | Slade . | |

FOREIGN PATENT DOCUMENTS

| | | | |
|---|---|---|---|
| 534502 | 3/1993 | European Pat. Off. | 312/223.3 |

*Primary Examiner*—Peter M. Cuomo
*Assistant Examiner*—Janet M. Wilkens
*Attorney, Agent, or Firm*—Price, Heneveld, Cooper, DeWitt & Litton

[57] ABSTRACT

A telescopingly adjustable furniture article is provided for filling an office space where the footprint dimensions of the office space are not known ahead of time or are likely to be periodically changed to different sizes. The furniture article includes a desk having a work surface with ends, a support for supporting one of the ends, and a foot on the other end. A storage unit or cabinet having a top is provided. The foot adjustably rests on the top so that the top supports the other end of the work surface, but so that the furniture unit is horizontally adjustable to different locations partially under the work surface. A Z-bracket interconnects the work surface to the top of the cabinet to secure the relationship of the cabinet and the desk. The furniture article can advantageously be used by itself, in combination with a building wall or demountable architectural wall, or in combination with a partition system to define a plurality of non-uniformly dimensioned offices. The furniture article is further adjustable to optimize use of space in the offices, but while staying within the dimensions of the office space footprints.

21 Claims, 8 Drawing Sheets

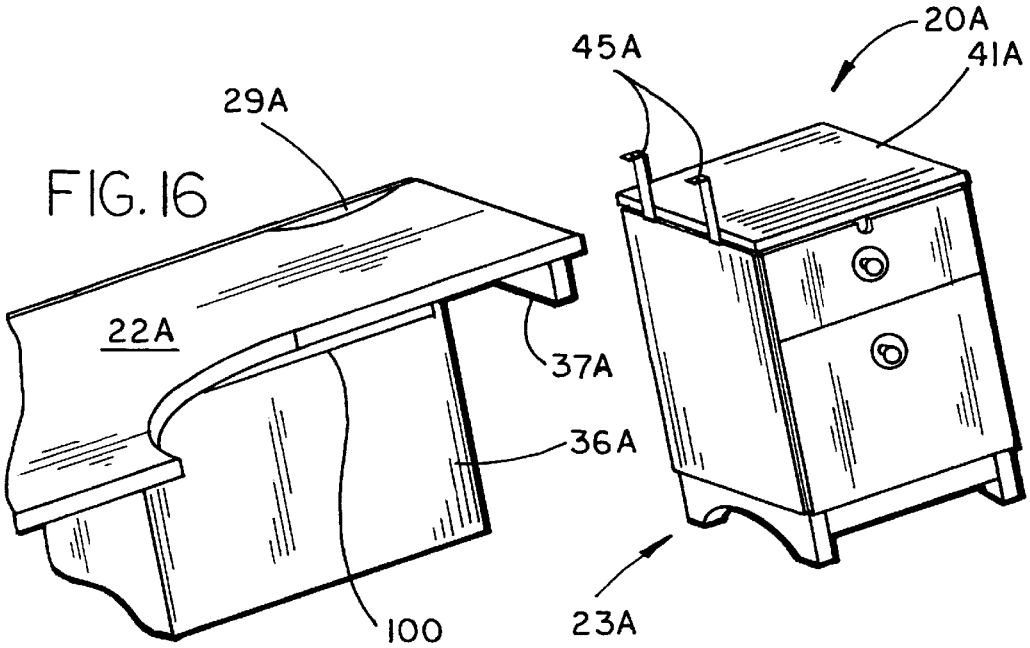
FIG. 16
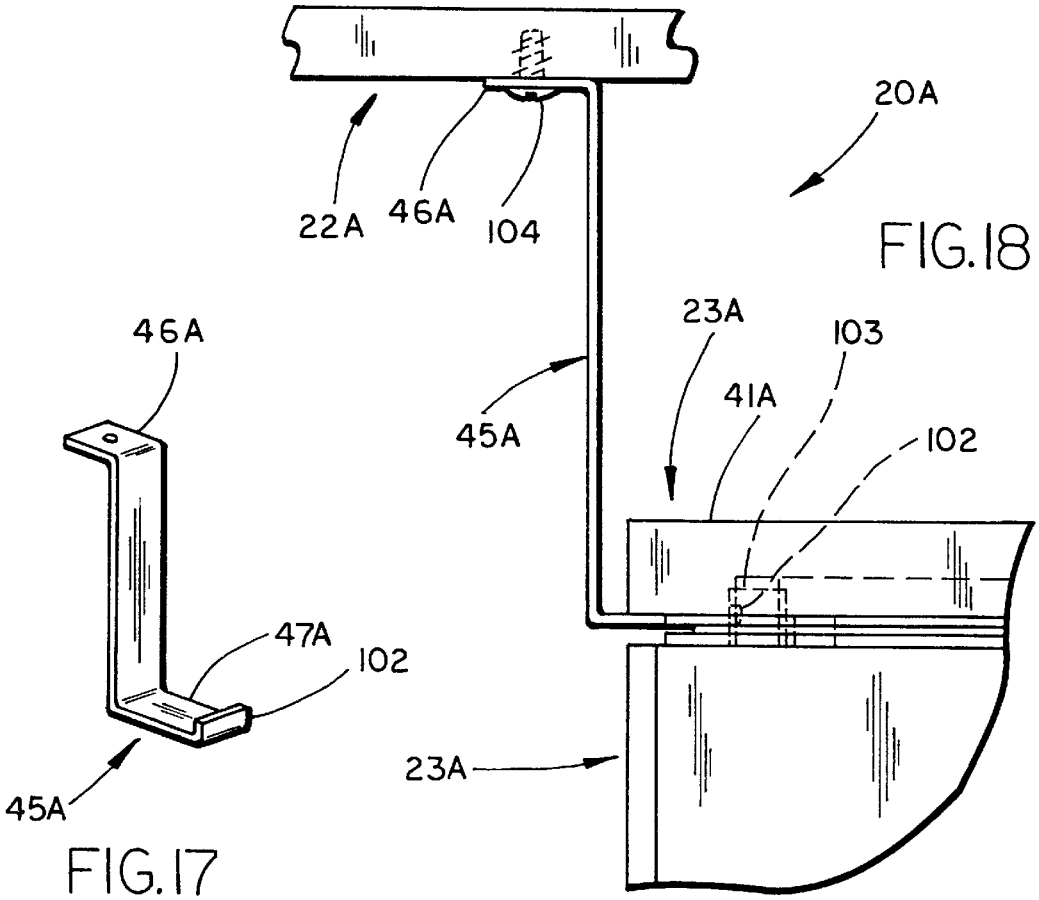
FIG. 18
FIG. 17

FREESTANDING FURNITURE DEFINING OFFICE WITH ADJUSTABLE FOOTPRINT

BACKGROUND OF THE INVENTION

The present invention concerns a furniture system adapted to expand and contract to form offices of different sizes and having different footprints in plan view.

Office space is costly. Also, the organization and layout of office space is very important to job efficiency and job satisfaction. Unfortunately, office needs cannot always be predicted ahead of time, and further the needs change. Thus, there is a tremendous need for a furniture system constructed to expand and contract with the available building space, and to provide on-site customized arrangements adaptable to form nonuniform office sizes, but without requiring a huge number of size-specific furniture. Notably, size-specific furniture is common, particularly in wood furniture, such that inventories of assembled units and also components therefor are often high, expensive and burdensome.

Thus, a furniture system solving the aforementioned needs is desired.

SUMMARY OF THE INVENTION

In one aspect, the present invention includes a furniture system having a plurality of expandable/collapsible furniture articles configured to form offices of different sizes and different footprints in plan view. Each furniture article includes a primary work surface, a telescopingly adjustable storage unit adjustably connected to and at least partially supporting one end of the primary work surface, and a vertically extending panel attached to the primary work surface for visually separating one office from another. Thus, the furniture articles can be arranged and rearranged to form offices of different sizes, with the furniture articles being adjusted to provide an optimal work area in each office but being arranged to be totally within a selected dimensional footprint.

In another aspect, the present invention includes a furniture article constructed to adjust and fill at least one dimension of an office footprint. The furniture article includes a desk having a work surface with ends, a support for supporting one of the ends, and a slip-fit leg on the other end. A furniture unit having a top is provided. The slip-fit leg adjustably engages the top so that the top supports the other end of the work surface, but so that the furniture unit is horizontally adjustable to different locations partially under the work surface.

In yet another aspect, the present invention includes a furniture article having a desk with a work surface, a support supporting one of the ends of the work surface, and a leg supporting the other end. The furniture article further includes a furniture unit with a storage section and a top, the leg engaging the top. A bracket is adjustably attached to an underside of the work surface and to the furniture unit to fix the location of the furniture unit relative to the work surface in an adjusted position.

These and other features, advantages and objects of the present invention will be further understood and appreciated by those skilled in the art by reference to the following specification, claims and appended drawings.

BRIEF DESCRIPTION OF THE DRAWINGS

FIG. 16 is an exploded perspective view showing the furniture article of FIG. 12;

FIG. 17 is a perspective view of the modified attachment bracket shown in FIG. 12;

FIG. 18 is a fragmentary side view showing the attachment bracket of FIG. 17 installed on the furniture article of FIG. 12;

DETAILED DESCRIPTION OF PREFERRED EMBODIMENT

Figures 1, 2, 3:
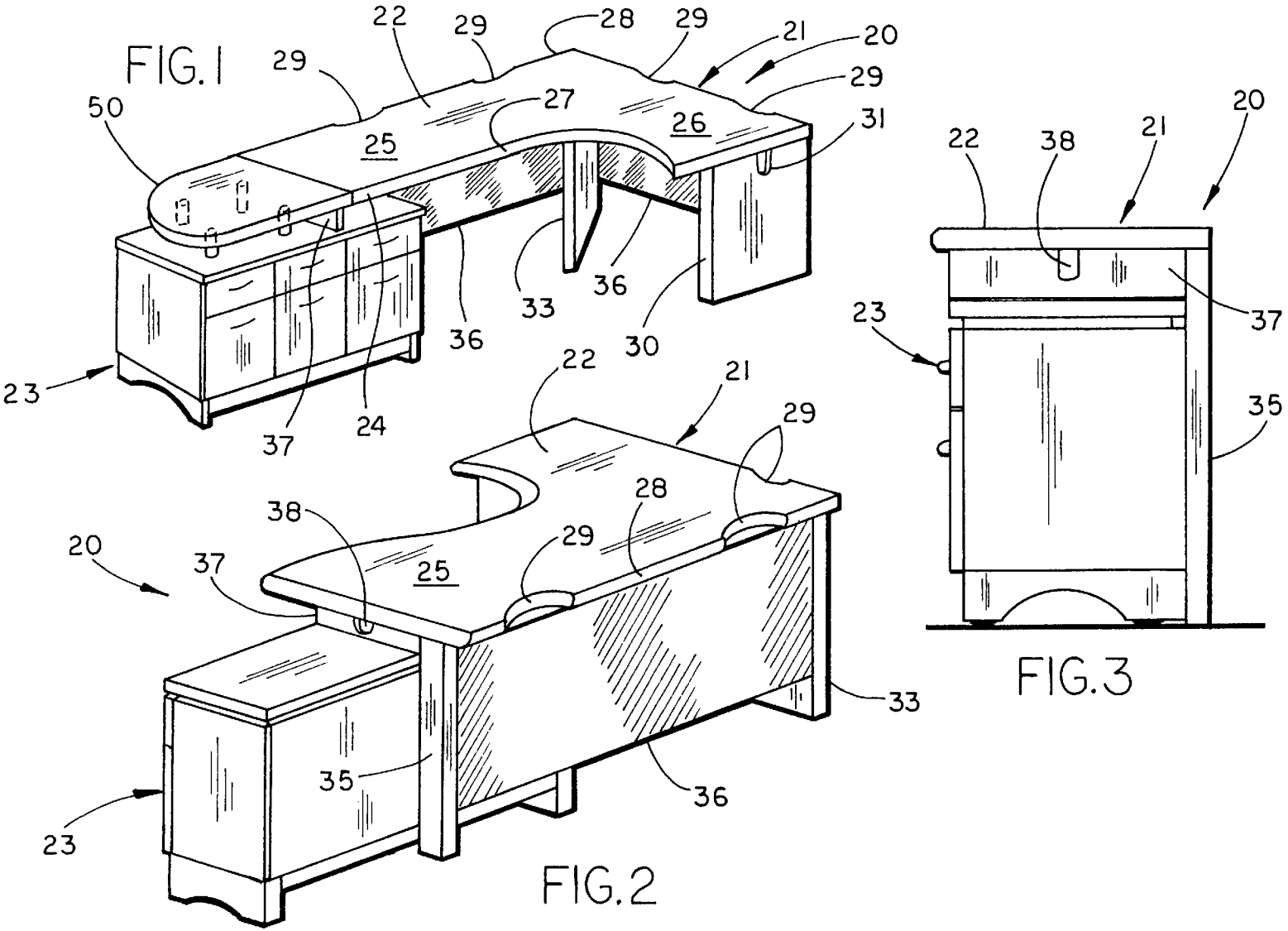
FIG. 1 is a front perspective view of a furniture article embodying the present invention.
FIG. 2 is a rear perspective view of the furniture article shown in FIG. 1.
FIG. 3 is an end view of the furniture article shown in FIG. 1.

Furniture article 20 (FIG. 1) embodying the present invention includes a freestanding desk unit 21 having a work surface 22, and a low-height storage unit or cabinet 23 supporting one end 24 of the work surface 22. The cabinet 23 is telescopingly adjustable under the work surface 22 to various positions. This allows the furniture article 20 to be adjusted to completely fill one side of an office arrangement, even if the dimension of the one side of the office arrangement is not known ahead of time and even if the dimension is changed during rearrangement of the office arrangement. Advantageously, the furniture arrangement 20 can be used to satisfy a plurality of needs, such as maximizing work surface in a given office arrangement, filling a space within a predetermined office footprint to prevent gaps, providing an optimal appearance, while also eliminating a need for a huge number of size specific furniture articles. The illustrated article 20 is substantially made of wood products, although the present invention is contemplated to include non-wood furniture and office systems as well.

The work surface 22 of desk 21 (FIG. 1) is L-shaped and includes a long section 25 and a short section 26 that extends orthogonally to long section 25. The front edge 27 of the work surface is radiused around its inner corner connecting the long and short sections 25 and 26 to provide an optimal user-friendly shape for use. The rear edge 28 of work surface 22 includes multiple cutouts 29 for providing vertical wire routing, such as for communication of power to computer equipment when the furniture article 20 is positioned against a wall or partition or other furniture.

Notably, it is contemplated that the present invention will also work on a "straight" rectangular worksurface, and accordingly the shape of the illustrated L-shaped worksurface should not be construed to be unnecessarily limiting.

An end panel or end support 30 is provided at the end of short section 26 for supporting the work surface 22 on a floor. An aperture 31 is formed at the top of end support 30 to provide for wire routing. A rear corner leg 33 is provided in a rear corner of the joinder of long and short sections 25 and 26.

Optionally, a second rear leg 35 (FIG. 2) is attached to the end of long section 25 along its rear edge 28. Back leg 35 supports an optional courtesy panel 36 that extends between corner leg 33 and rear leg 35, and that is located generally under rear edge 28 of long section 25. Rear leg 35 is not required unless the courtesy panel 36 is desired, or unless additional support is required for work surface 22. A panel type leg or 37 is located under the end of long section 25 generally aligned with rear leg 35. Leg 37 comprises a wood panel that extends generally from a front to a rear of the work surface 22. An aperture 38 is formed in leg 37 along a top edge thereof for wire routing and for receiving a connector bracket 57 described below.

Figure 4:
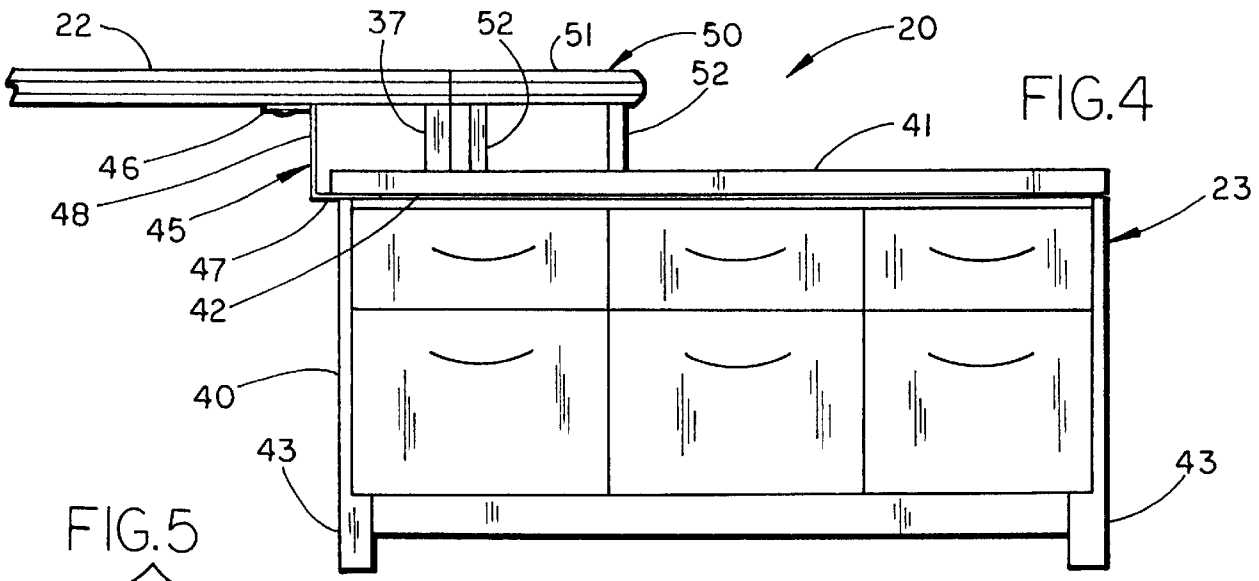
FIG. 4 is a fragmentary front view of the furniture article shown in FIG. 1.

Cabinet 23 (FIG. 4) includes a three-drawer wide storage unit 40. Notably, a one or two drawer cabinet or a cabinet with shelves (with or without doors) could also be used. In the illustrated cabinet 23, a top 41 is provided that is spaced above storage unit 40 to create a gap 42 therebetween. Legs 43 extend downwardly from storage unit 40 for supporting the cabinet 23 on a floor surface. Notably, it is contemplated that the present invention includes a variety of different furniture units, such as ones having a panel-type flat top. It is also contemplated that the furniture units may or may not include drawers, doors, and other closed storage type devices.

Figure 6:
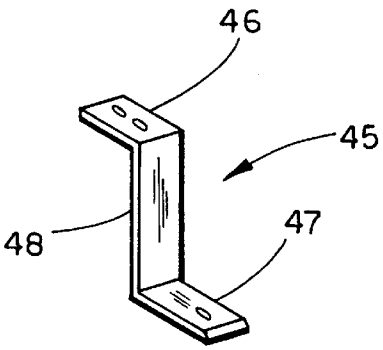
FIG. 6 is a perspective view of the Z-bracket shown in FIG. 4.
Figure 5:
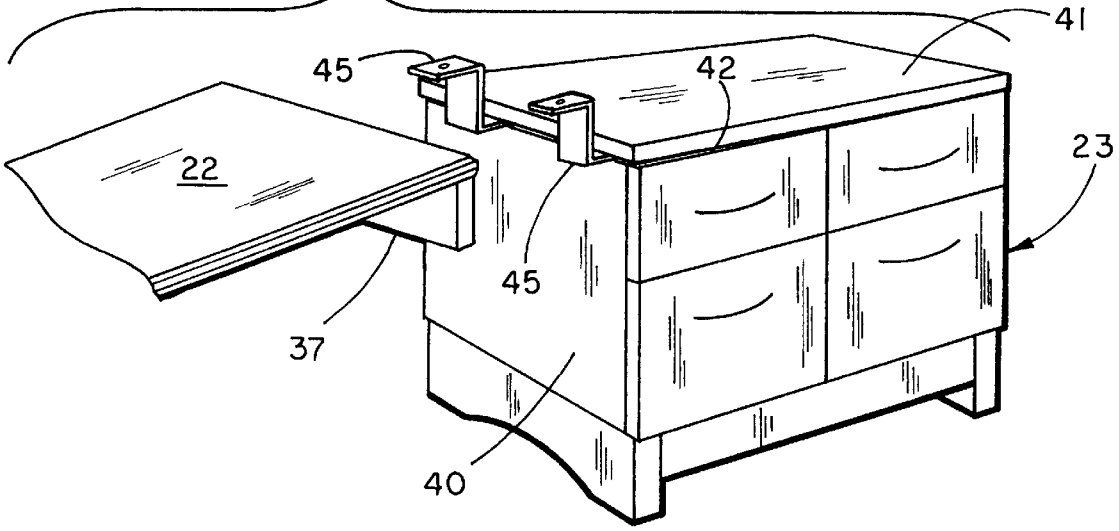
FIG. 5 is a partially exploded view of the furniture article shown in FIG. 1 but wherein the storage unit is a two-wide type storage unit.

A Z-bracket 45 (FIG. 6) is configured to adjustably but fixedly connect desk unit 21 and cabinet 23. The bracket 45 includes a top flange 46 adapted for screw attachment to an underside of the work surface 22, and further includes a bottom flange 47 configured to extend into the gap 42. Bottom flange 47 includes an aperture so that it can be screw attached to a bottom surface of the top 41. Notably, one or more Z-brackets can be used to connect cabinet 23 to desk 21 as required/desired. A middle section 48 of Z-bracket 45 spaces flanges 46 and 47 apart vertically a predetermined dimension so that the bracket mates with the underside of top 41 of cabinet 23 and with the underside of work surface 22 of desk 21.

Figure 7:
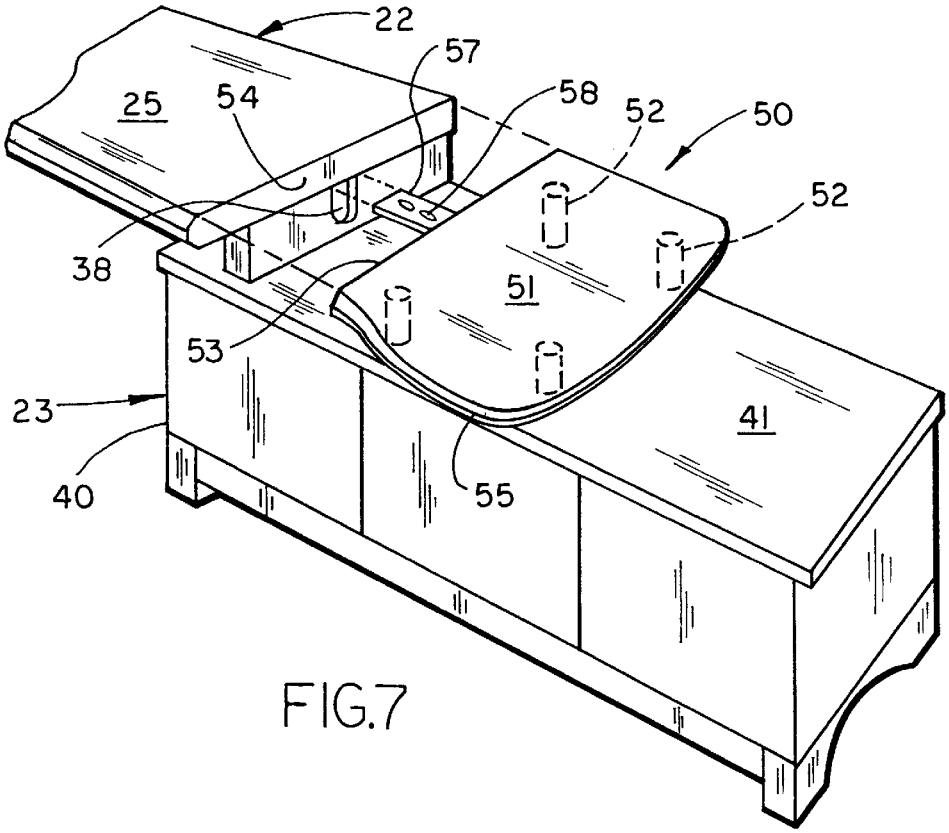
FIG. 7 is an exploded perspective view of the furniture article shown in FIG. 1 including the work surface extension.

A work surface extension 50 (FIG. 7) is provided to aesthetically visually terminate the end of the work surface 22 above cabinet 23. Extension 50 includes a top 51 and multiple legs 52 for supporting the top 51 above cabinet top 41. The legs 52 are spaced apart to stably support the top 51 and align it with the work surface 22. The top 51 includes an edge 53 configured to matingly abut the end surface 54 of long section 25 of work surface 22. The remaining perimeter 55 of work surface extension top 51 is shaped to provide a visually attractive termination of the work surface 22. A tongue bracket 57 extends from edge 53 and is configured to extend through aperture 38 to an underside of work surface 22. The tongue bracket includes apertures 58 for receiving screws to secure the work surface extension 50 tightly against work surface 22. The legs 52 preferably include padded bottom surfaces to minimize scuffing and marring of the cabinet top 41, thus permitting later adjustment without leaving telltale mars.

Figure 8:
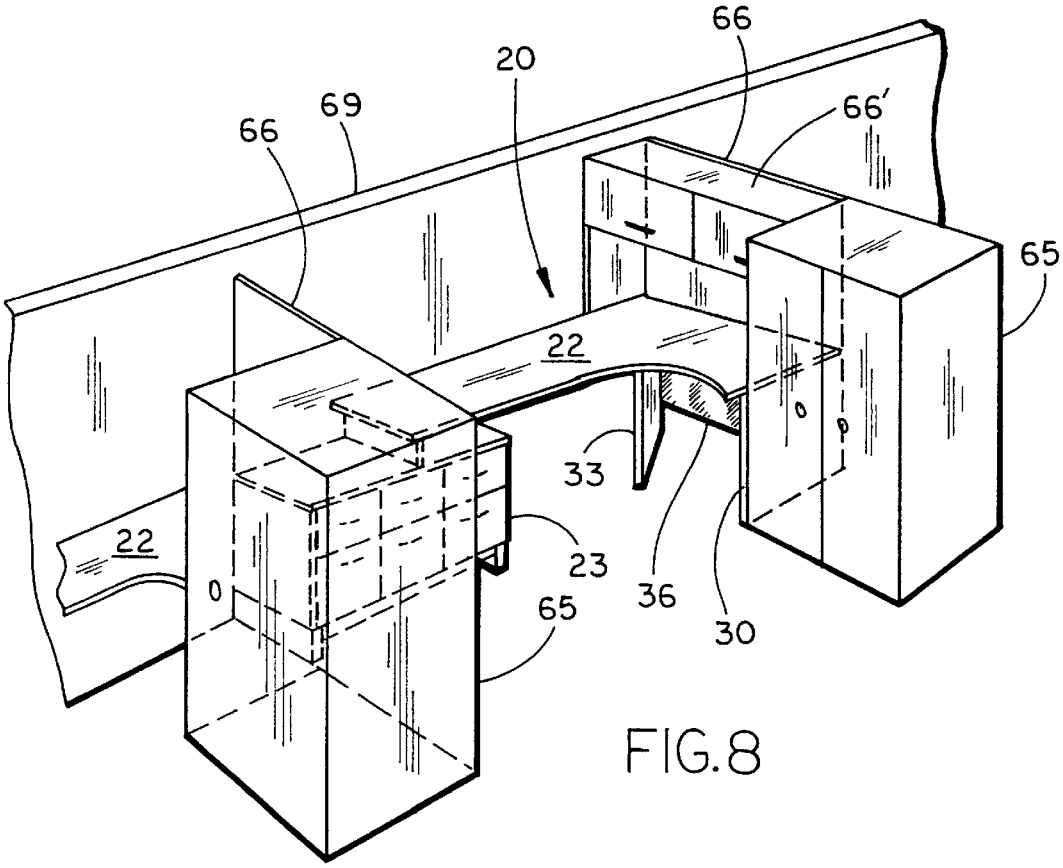
FIG. 8 is a perspective view showing a furniture system incorporating the furniture article shown in FIG. 1, including a screen and a high storage cabinet.

The furniture article 20 can be used as freestanding furniture positioned against a permanent building wall 69 (FIG. 8) or a demountable architectural wall (not shown per se) to define a plurality of offices. As illustrated, a head-high cabinet 65 is positioned adjacent the end of short section 26 to provide visual and physical separation of offices. A screen 66 optionally is attached to a back side of the desk 21 such as to the back of the courtesy panel 36 and extends with the screen 66 extending above work surface 22. Alternatively, the screen can be attached between the tall cabinet 65 and the building wall 69. Also, FIG. 8 illustrates that a book binder, hutch, or other overhead storage unit 66' can be supported on the work surface to provide visual division of office space.

Figure 9:
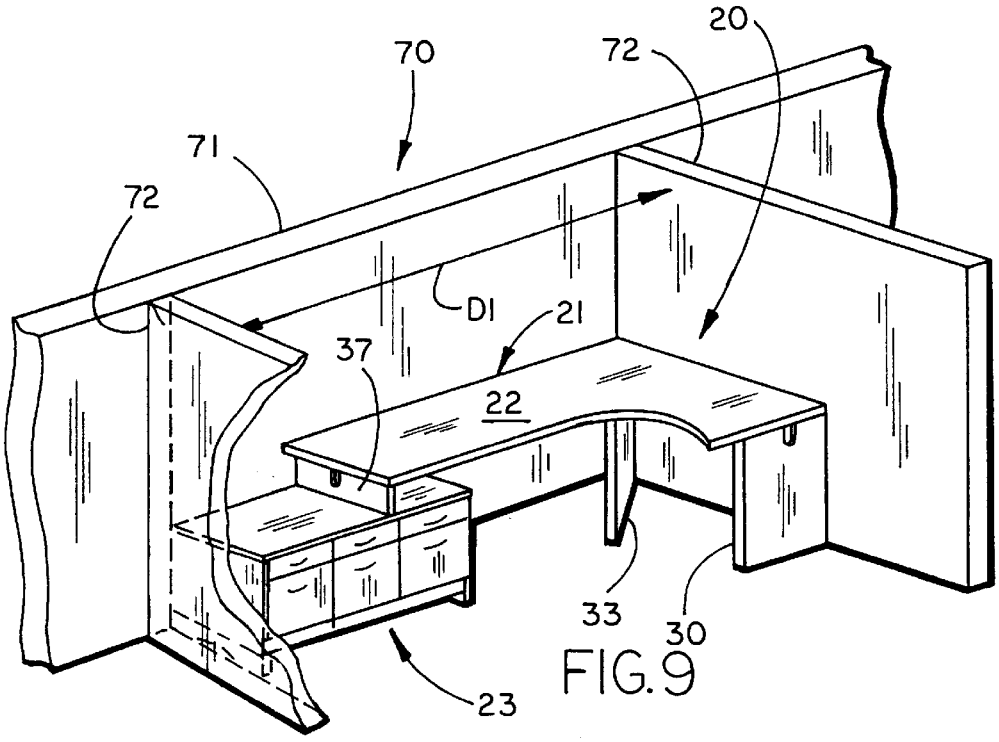
FIG. 9 is a furniture system incorporating the furniture article shown in FIG. 1 including a partition panel system, several of the partition panels being positioned off module and adjustably connected to a main run of partition panel.

In another embodiment, the furniture article 20 is positioned within a building space subdivided into offices by an adjustable partition system 70 (FIG. 9). The partition system 70 is defined in detail in co-assigned co-pending Pat. application Ser. No. 08/686,913 filed Jul. 26, 1996 entitled PARTITION CONSTRUCTION AND TRIM SYSTEM THEREFORE, the entire contents of which are incorporated herein by reference.

Partition system 70 need not described herein in detail for a complete understanding of the present invention. Nonetheless, to facilitate a present understanding, it is noted that partition system 70 includes a main run of partitions 71 (called a "spine wall" herein) and also includes off-module position panels 72 (called "fin walls" herein) connected to the main run of panel 71. The fin-wall panels 72 are adjustable to different incrementally different positions along the main run of panels 71 such that offices of different dimensional sizes or footprints are possible. The present furniture article 20 is particularly adapted to be positioned within these adjustably sized offices, since the furniture article 20 can be expanded or contracted to completely fill a particular dimension D1 within the adjustable offices, even where the dimension is not known ahead of time, or where the dimension may change during office rearrangement. Thus, the furniture article 20 eliminates any undesired gaps or "rats nests" within the adjustable offices.

Figure 10:
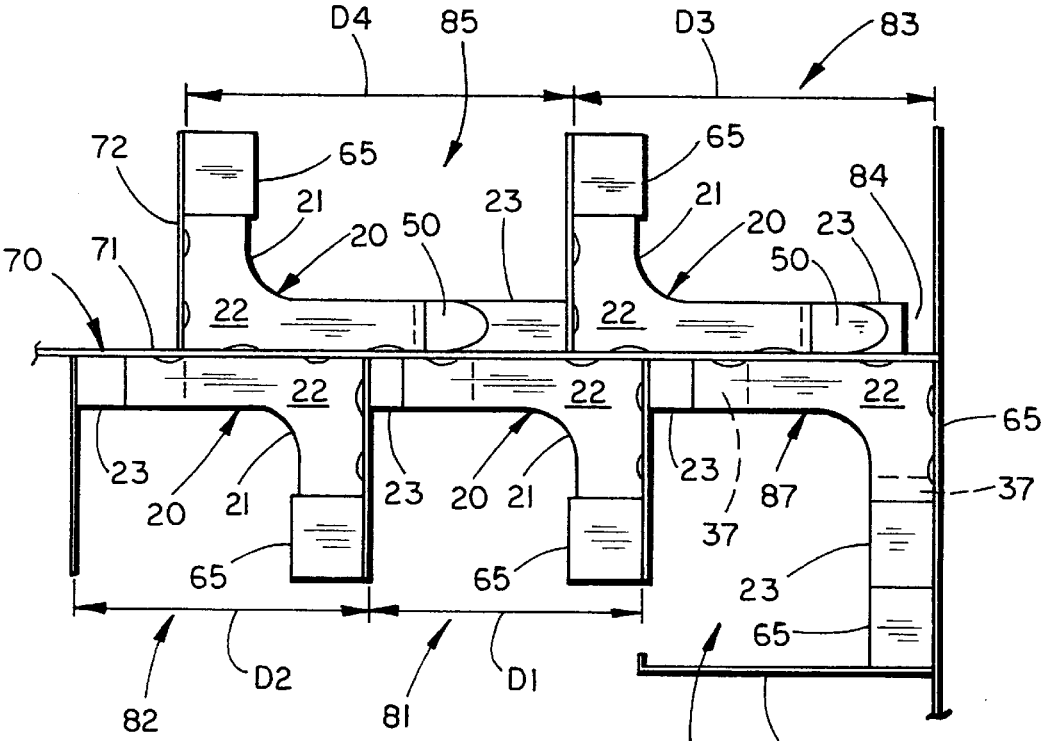
FIG. 10 is a schematic plan view of the furniture system shown in FIG. 9, the illustrated office arrangement including five differently sized offices.

FIG. 10 is an example showing five offices each with a different dimension. Notably, in FIG. 10, the furniture articles shown include a first office 81 with a furniture article 20 having a desk 21 and a two-drawer cabinet 23A for completely filling one side having a first dimension D1. FIG. 10 further illustrates a second office 82 having a furniture article 20 with a two-drawer cabinet 23 adjusted under the desk 21 to a dimension D2 that is larger than dimension D1. Also illustrated is an office 83 having a furniture article 20 utilizing a two-drawer cabinet 23 and positioned to define a predetermined corner space 84 for receiving materials for storage (e.g. rolled drawings or the like). Also shown is a fourth office 85 with a furniture article 20, which office utilizes a three-drawer cabinet 23 and a work surface extension 50, this last office defining a dimension D4 that is considerably larger than D1 and D2, and somewhat larger than dimension D3. A fifth office 86 is shown having a furniture article 87 that is adjustable in two directions, as described below.

Figure 11:
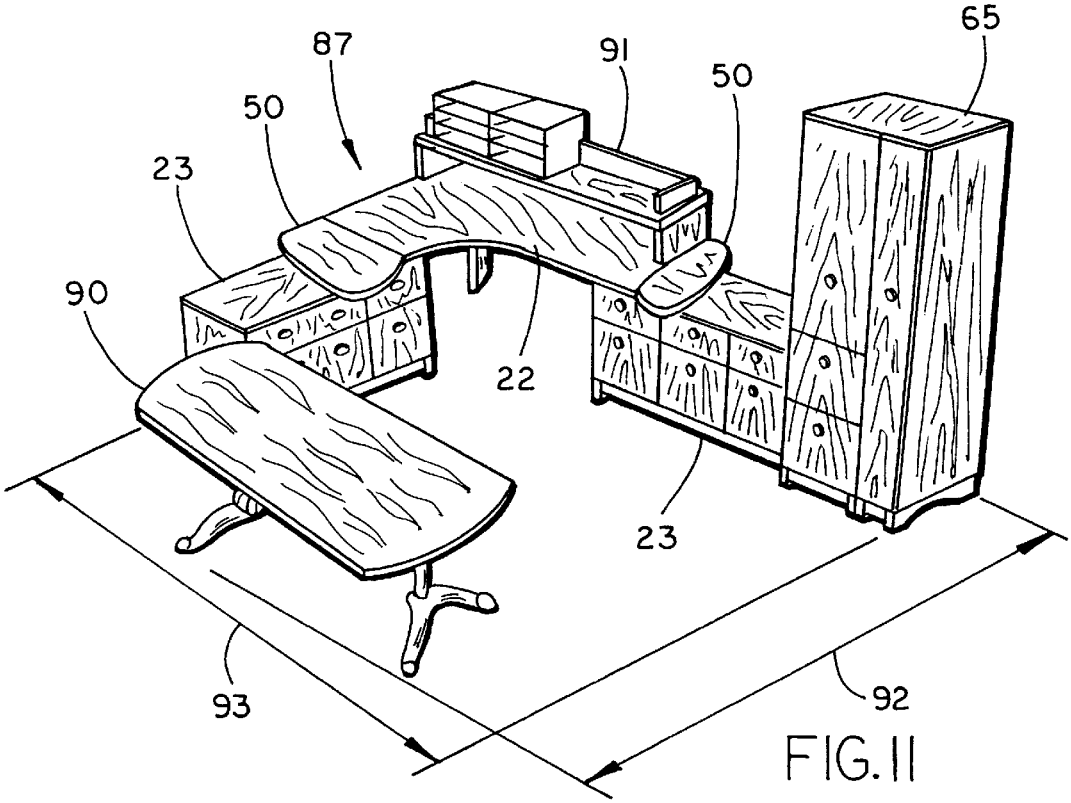
FIG. 11 is a perspective view showing the furniture system of FIG. 1 incorporated into a stand-alone office that is adjustable in size orthogonal directions.
Figure 12:
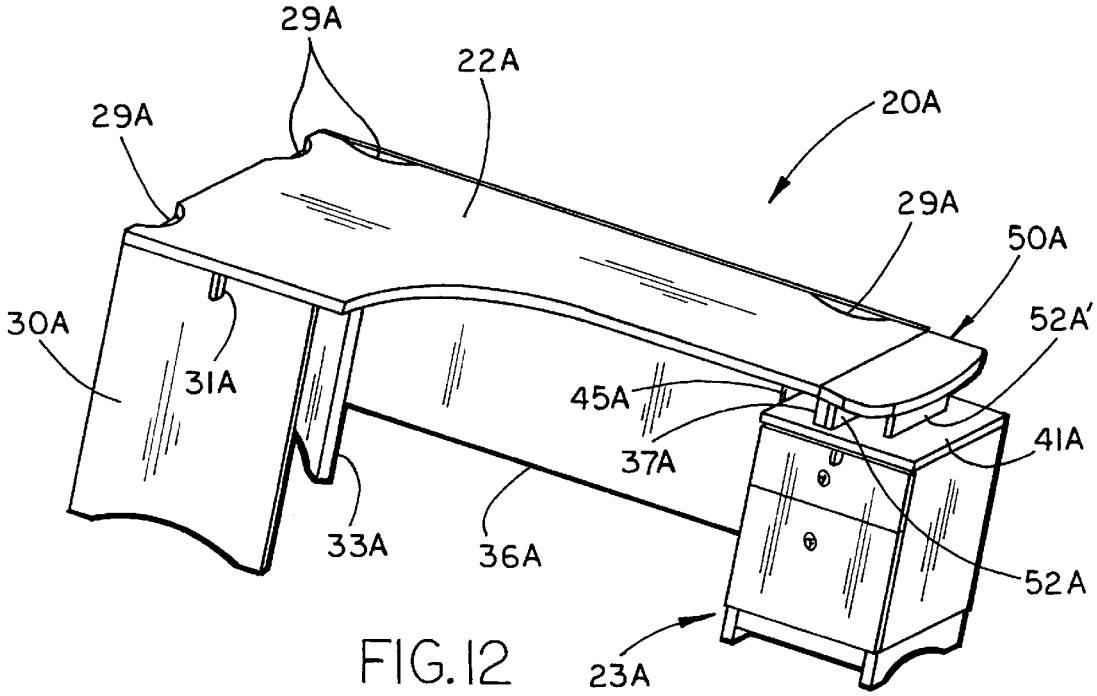
FIG. 12 is a front perspective view showing a modified furniture article embodying the present invention.
Figure 13:
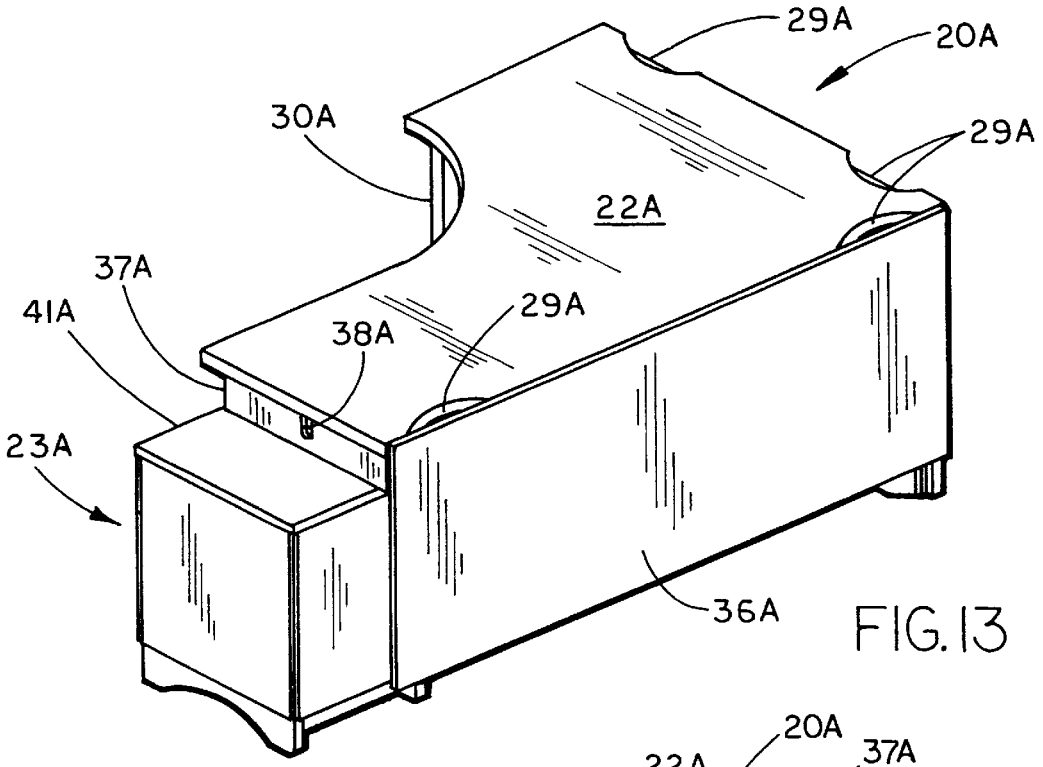
FIG. 13 is a rear perspective view showing the modified furniture article of FIG. 12.
Figure 14:
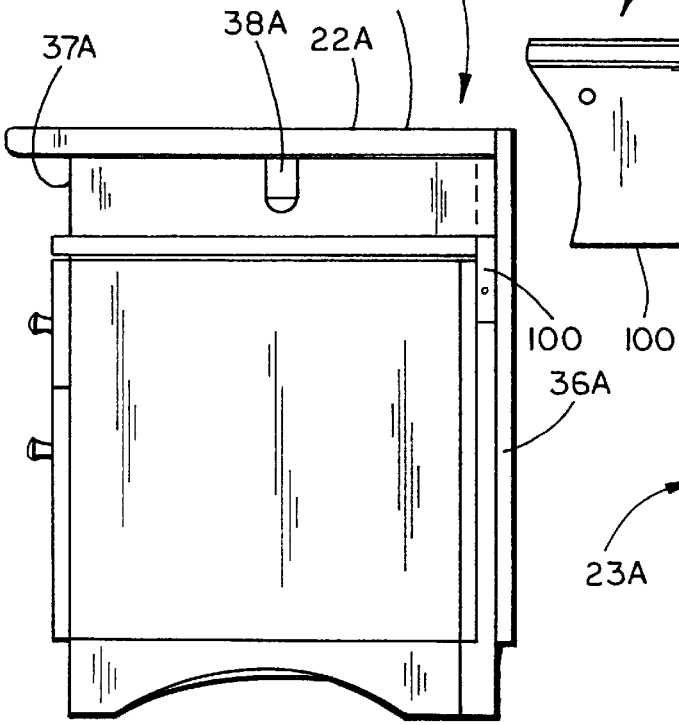
FIG. 14 is an end view of the furniture article shown in FIG. 12.

Furniture article 87 (FIG. 11) includes components identical or similar components to furniture article 20, and identical identification numbers are used to reduce redundant discussion. Basically, in furniture article 87, the end support 30 is eliminated, and a second cabinet 23 is used in combination with a second foot 37 and second bracket 45 to support short section 26 of work surface 22. A table 90 and top-mounted bookcase/shelf 91 finish the office to dimensions 92 and 93.

Figure 15:
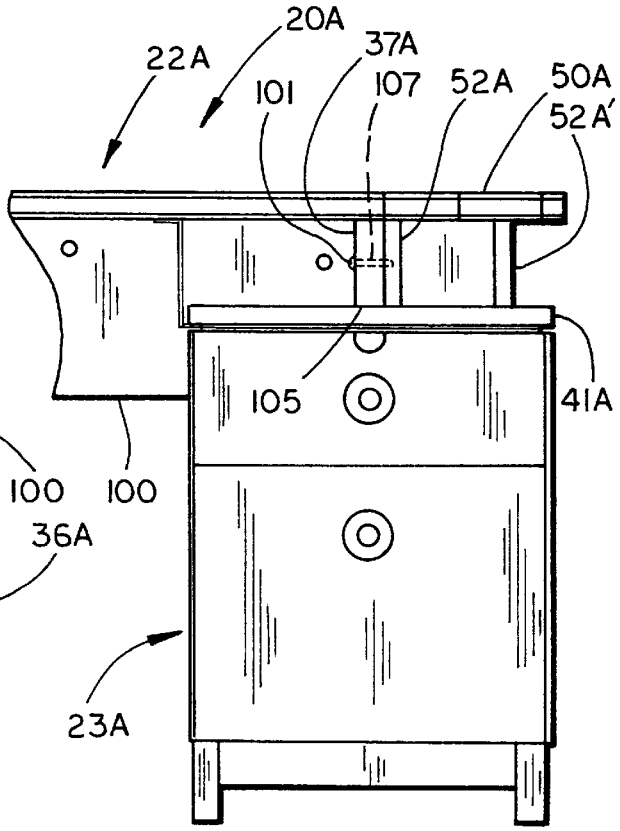
FIG. 15 is a front view showing the furniture article of FIG. 12.
Figure 19:
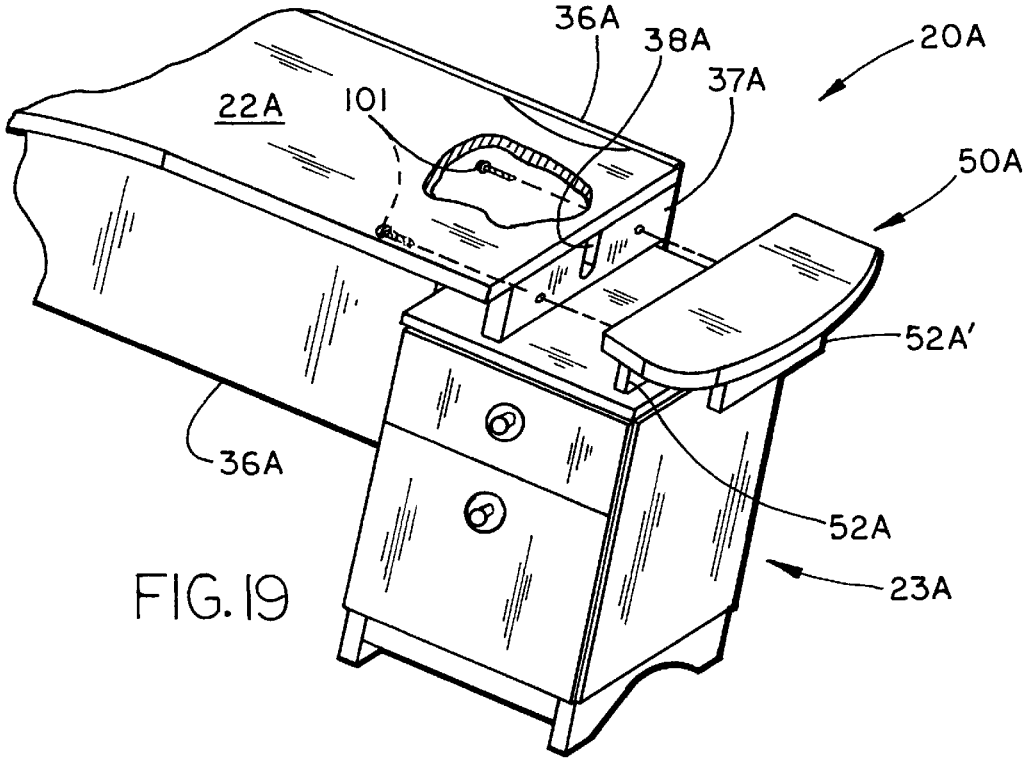
FIG. 19 is an exploded fragmentary perspective view of the furniture article shown in FIG. 12.
Figure 20:
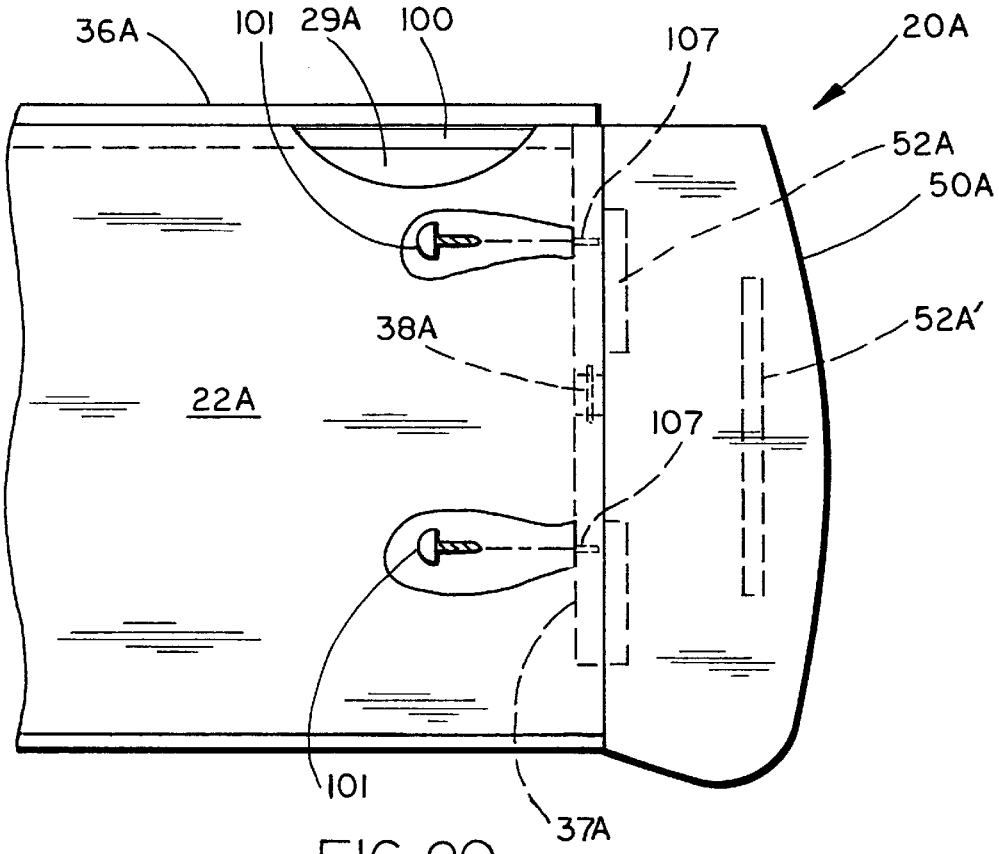
FIG. 20 is a partially exploded fragmentary top view of the furniture article shown in FIG. 12.

A modified furniture article 20A is illustrated in FIGS. 12–20. In modified furniture article 20A, all features and components that are identical to or similar to the furniture article 20 are identified with identical numbers, but with the additional letter "A". For example, the furniture article 20A includes cutouts 29A, an end support 30A, an aperture 31A, a corner leg 33A, and an aperture 38A. In furniture article 20A, the back leg 35 (FIG. 2) has been eliminated. An inner back panel 100 (FIGS. 14 and 15) is attached to worksurface 22A and is attached to an inside of the leg 37A. The inner back panel 100 is about twice the height of leg 37A and extends below leg 37A. Inner back panel 100 engages a back end of the cabinet 23A and acts as a stop to accurately position the cabinet 23A under the worksurface 22A. Further, the inner back panel 100 provides a mounting surface for attachment of the optional courtesy panel 36A. The worksurface extension 50A includes a first panel leg 52A and a second panel leg 52A' (FIG. 15). Panel leg 52A is located adjacent leg 37A and is attached thereto by screws 101 (FIG. 19). Bracket 45A (FIGS. 17 and 18) includes a lower leg 47A having a lip 102 configured to engage a recess 103 in the bottom surface of top 41A of cabinet 23A. The upper end 46A screw attaches to the underside of the worksurface 22A using a screw 104. The bracket 45A is configured so that when it is attached, it draws the worksurface 22A downwardly, thus compressing leg 37A (FIG. 15). The leg 37A includes a rubber shoe 105 (or other non-abrasive material such as felt or soft plastic) on its bottom to prevent marring of the cabinet top 41A. Further, the rubber shoe 105 provides a relatively high coefficient of friction to prevent inadvertent movement of the cabinet 23A relative to the worksurface 22A. It is noted that the screws 101 go to holes 107 in leg 37A. The holes 107 (FIG. 20) are predrilled but do not pierce the outer surface of the leg 37A such that the furniture article 20A can be used without the worksurface extension 50A (FIG. 20). When a screw 101 is used, it pierces the end of the hole 107 and extends into leg 52A.

Accordingly, a telescopingly adjustable furniture system is provided, including furniture articles configured to adjustably fill an office space where the footprint dimensions of the office space are not known ahead of time, or where the office space is likely to be periodically adjusted in size. The furniture system includes a plurality of freestanding desks and cabinets that can be telescopingly adjusted relative to each other, and that can be used in combination with other space-dividing furniture such as tall cabinets and screens, permanent building walls, or partitions. In particular, the present furniture article is particularly useful in combination with partition systems having thin wall partitions adjustably attached to other partitions and reconfigurable to form offices of different sizes.

The above description is considered that of the preferred embodiment(s) only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The embodiments of the invention in which an exclusive property or privilege is claimed are defined as follows:

1. A furniture system comprising:

a plurality of expandable/collapsible furniture articles configured to form offices of different sizes and footprints in plan view;

each furniture article including a primary work surface having a vertically extending leg, a telescopingly adjustable storage unit adjustably engaged by the leg for supporting one end of the primary work surface, and a vertically extending panel attached to the primary work surface for visually separating one office from another; and a bracket on each furniture article separate from the leg that is constructed to compress the leg and concurrently secure an associated one of the storage units to an associated one of the primary work surfaces in a customized adjusted location;

whereby the furniture articles can be arranged and rearranged to form offices of different sizes, with the furniture articles being adjusted to provide an optimal work area in each office but being arranged to be located totally within a selected dimensional footprint.

2. The furniture system defined in claim 1 wherein at least one of the storage units is a cabinet.

3. The furniture system defined in claim 2 wherein the cabinet is a low-height cabinet having a total height less than a height of an associated one of the primary work surfaces.

4. The furniture system defined in claim 3 wherein the cabinet includes a top, and one end of the associated primary work surface is supported on the top.

5. The furniture system defined in claim 4 including a work surface extension supported on the top of the cabinet and located generally adjacent the one end of the associated primary work surface.

6. The furniture system defined in claim 5 wherein the work surface extension is attached to the one end of the associated primary work surface.

7. The furniture system defined in claim 1 wherein at least one of the storage units is freestanding and includes a top, and wherein one end of an associated one of the primary work surfaces is supported on the top.

8. The furniture system defined in claim 7 including a work surface extension attached to the one end of the associated primary work surface and supported on the top of the at least one storage unit.

9. The furniture system defined in claim 1 wherein at least one of the vertically extending panels is attached along a rear edge of an associated one of the primary work surfaces, the at least one vertically extending panel being located at least partially behind an associated one of the storage units.

10. The furniture system defined in claim 1 wherein at least one of the work surfaces is L-shaped.

11. The furniture system defined in claim 1 wherein at least one of the vertically extended panels includes a courtesy panel supported along a rear edge of an associated one of the primary work surfaces.

12. The furniture system defined in claim 1 including a tall cabinet having a side generally aligned with one of the vertically extending panels for visually separating one office from another.

13. The furniture system defined in claim 1 including a partition system positioned along an edge of one of the work surfaces for visually separating one office from another.

14. The furniture system defined in claim 1 wherein at least one of the vertically extending panels includes an upwardly extending furniture component located on an associated one of the primary work surfaces for visually separating one office from another.

15. The furniture system defined in claim 1 wherein at least one of the primary work surfaces includes a leg that is elongated and that extends from a front to a rear of the primary work surface, the leg including an aperture to facilitate routing of wiring through the leg.

16. The furniture system defined in claim 1 including a second storage unit adjustably connected to the another end of at least one of the primary work surfaces, one of the first mentioned storage units and the second storage unit each being telescopingly adjustable relative to an associated one of the primary work surfaces.

17. A furniture system comprising:

a plurality of expandable/collapsible furniture articles configured to form offices of different sizes and footprints in plan view; and each furniture article including a primary work surface, a telescopingly adjustable storage unit adjustably connected to and at least partially supporting one end of the primary work surface, and a vertically extending panel attached to the primary work surface for visually separating one office from another, the primary work surface including an elongated leg that extends from a front to a rear of the primary work surface and that includes an aperture to facilitate routing of wiring through the leg, each furniture article further including a bracket separate from the leg that compresses the leg and secures the storage unit to the primary work surface in a known location;

whereby the furniture articles can be arranged and rearranged to form offices of different sizes, with the furniture articles being adjusted to provide an optimal work area in each office but being arranged to be located totally within a selected dimensional footprint.

18. A furniture article constructed to adjust and fill at least one dimension of an office footprint, where the office footprint is not known at the time of manufacturing the furniture article, comprising:

a desk having a work surface with ends, a support supporting one of the ends, and a slip-fit leg on the other end;

a furniture unit having a top, the leg adjustably engaging the top so that the top supports the other end of the work surface that the furniture unit is horizontally adjustable to different locations partially under the work surface, such that the furniture article is adjustable to completely fill one of the dimensions of an office; and a configured bracket separate from the leg that is constructed to compress the leg and that is constructed to secure the desk to the furniture unit in a known selected location.

19. The furniture article defined in claim 18 wherein the furniture unit comprises a cabinet.

20. A furniture article adapted to adjust and fill at least one dimension of an office footprint, where the furniture article is manufactured before the at least one dimension is known, comprising:

a desk having a work surface with ends, a support supporting one of the ends, and a leg supporting the other of the ends;

a furniture unit having a storage section and having a top, the leg engaging the top; and a bracket adjustably engaging the work surface and the furniture unit to fix the location of the furniture unit relative to the work surface in an adjusted position; the bracket including a first end engaging the furniture unit under the top, a second end attached to an underside of the work surface, and a middle section connecting the first and second ends and vertically spacing the first and second ends apart, the bracket being configured to draw the leg against the top.

21. A furniture system comprising:

a plurality of expandable/collapsible furniture articles configured to form offices of different sizes and footprints in plan view; and each furniture article including a primary work surface having a vertically extending leg, a telescopingly adjustable storage unit adjustably engaged by the leg for supporting one end of the primary work surface, a vertically extending panel attached to the primary work surface for visually separating one office from another, and a Z-shaped bracket separate from the leg that is constructed to adjustably secure the storage unit to the primary work surface on each furniture article;

whereby the furniture articles can be arranged and rearranged to form offices of different sizes, with the furniture articles being adjusted to provide an optimal work area in each office but being arranged to be located totally within a selected dimensional footprint.

* * * * *